US009052134B1

(12) United States Patent
Batchler

(10) Patent No.: US 9,052,134 B1
(45) Date of Patent: Jun. 9, 2015

(54) REFRIGERATOR TURNTABLE ASSEMBLY

(71) Applicant: Carvis H. Batchler, Blacksburg, SC (US)

(72) Inventor: Carvis H. Batchler, Blacksburg, SC (US)

( * ) Notice: Subject to any disclaimer, the term of this patent is extended or adjusted under 35 U.S.C. 154(b) by 91 days.

(21) Appl. No.: 13/920,664

(22) Filed: Jun. 18, 2013

(51) Int. Cl.

| | |
|---|---|
| ***A47B 91/00*** | (2006.01) |
| ***A47B 95/00*** | (2006.01) |
| ***F25D 25/02*** | (2006.01) |
| *F25D 25/00* | (2006.01) |

(52) U.S. Cl.
CPC ..... *F25D 25/027* (2013.01); *F25D 25/00* (2013.01); *F25D 25/02* (2013.01)

(58) Field of Classification Search
CPC ..... F25D 25/027; F25D 25/00; F25D 25/02
USPC ..... 312/408, 305, 238, 405.1, 321.5; 248/346.01, 346.03, 349.1
See application file for complete search history.

(56) References Cited

U.S. PATENT DOCUMENTS

| | | | | |
|---|---|---|---|---|
| 2,403,164 | A | 7/1946 | Ahrens et al. | |
| 4,191,437 | A * | 3/1980 | Funke | 312/305 |
| 6,385,991 | B1 | 5/2002 | Romanosky | |
| 6,585,119 | B2 * | 7/2003 | Palder | 211/49.1 |
| 6,854,608 | B2 | 2/2005 | McNeeley et al. | |
| 6,883,887 | B1 | 4/2005 | Mogensen | |
| D660,326 | S | 5/2012 | Allette | |
| 8,641,158 | B1 * | 2/2014 | Conner, Sr. | 312/408 |

* cited by examiner

*Primary Examiner* — Amy Sterling

(57) ABSTRACT

A refrigerator turntable assembly facilitates access to items stored in a refrigerator. The assembly includes a shelf having opposed side edges. A pair of supports is coupled to opposed sides of a refrigerator. The side edges of the shelf are supported by the supports within the refrigerator. A base is positioned on the shelf. A bearing plate has a bottom surface coupled to the base. A top surface of the bearing plate is rotatable relative to the bottom surface of the bearing plate. A table is coupled to the upper surface of the bearing plate wherein the table is rotatable relative to the shelf.

8 Claims, 6 Drawing Sheets

REFRIGERATOR TURNTABLE ASSEMBLY

BACKGROUND OF THE DISCLOSURE

Field of the Disclosure

The disclosure relates to refrigerator shelf devices and more particularly pertains to a new refrigerator shelf device for facilitating access to items stored in a refrigerator.

SUMMARY OF THE DISCLOSURE

An embodiment of the disclosure meets the needs presented above by generally comprising a shelf having opposed side edges. A pair of supports is coupled to opposed sides of a refrigerator. The side edges of the shelf are supported by the supports within the refrigerator. A base is positioned on the shelf. A bearing plate has a bottom surface coupled to the base. A top surface of the bearing plate is rotatable relative to the bottom surface of the bearing plate. A table is coupled to the upper surface of the bearing plate wherein the table is rotatable relative to the shelf.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
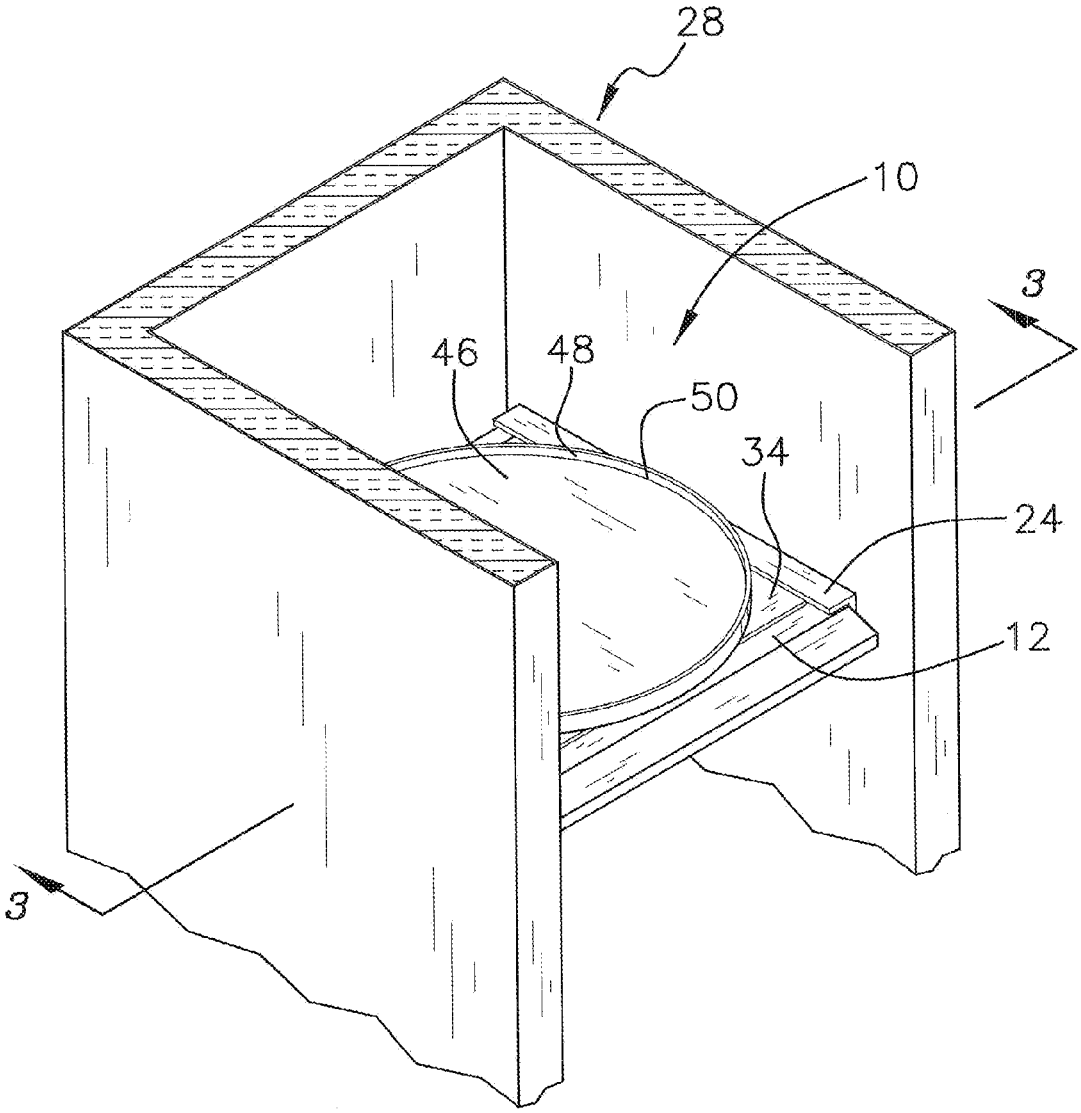
FIG. 1 is a top front side perspective view of a refrigerator turntable assembly according to an embodiment of the disclosure.
Figure 2:
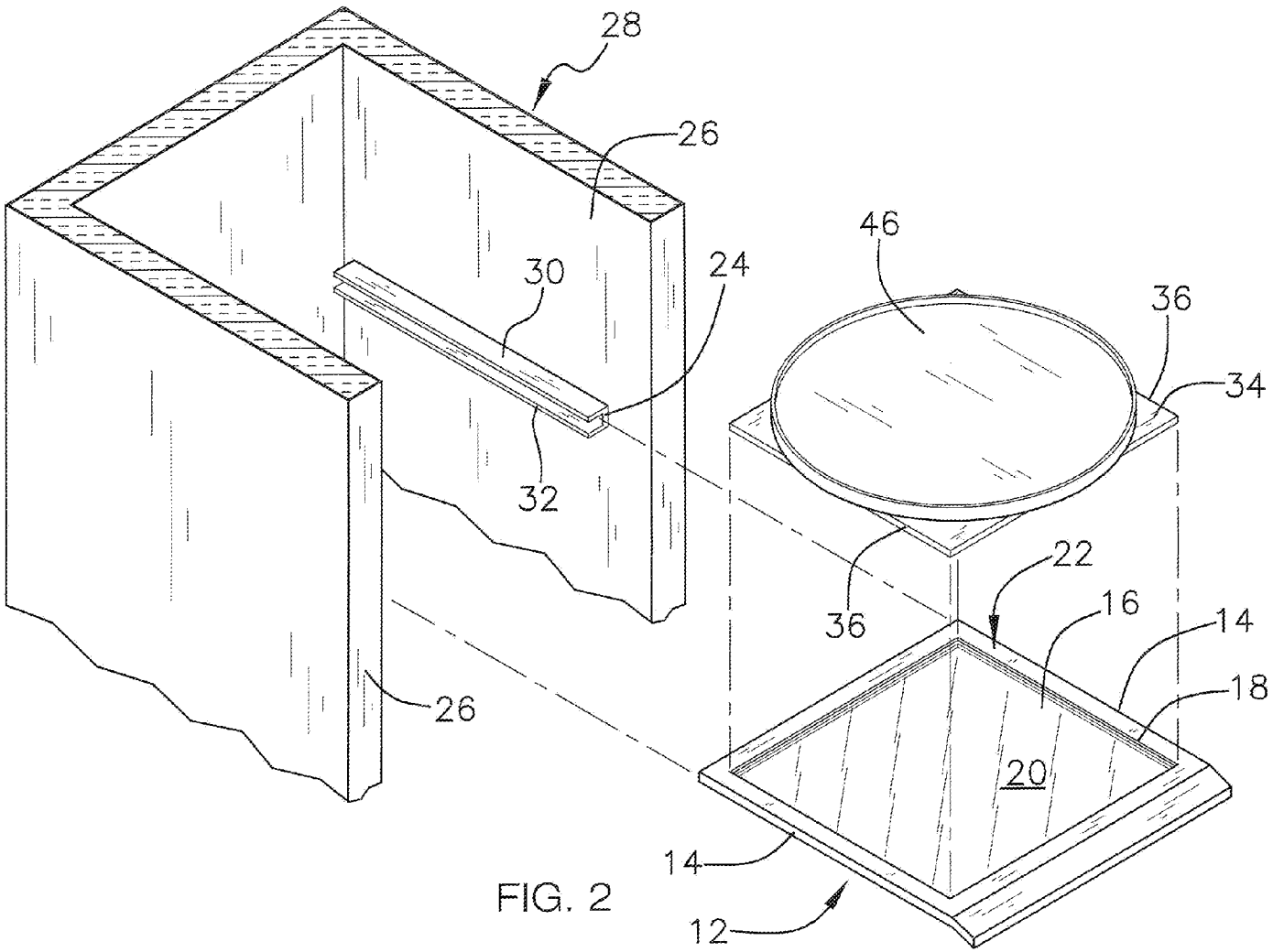
FIG. 2 is a partially exploded view of an embodiment of the disclosure.
Figure 3:
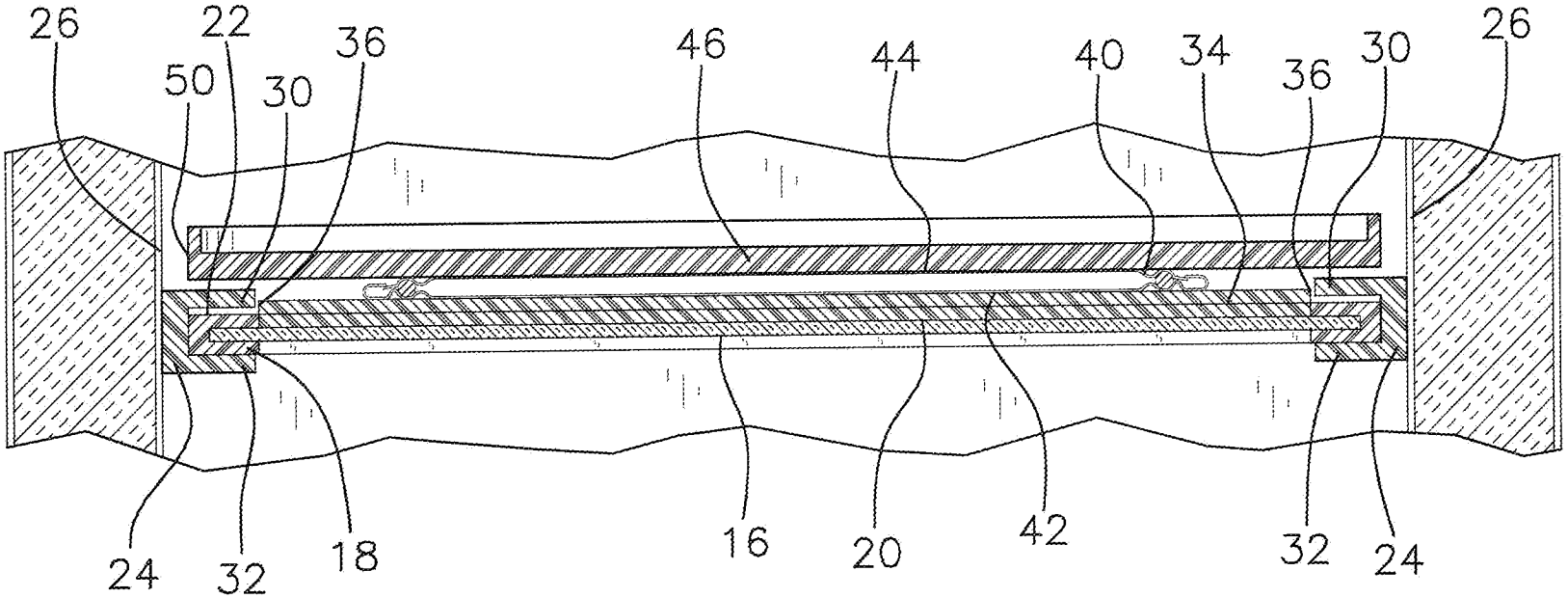
FIG. 3 is a cross-sectional view of an embodiment of the disclosure taken along line 3-3 of FIG. 1.
Figure 4:
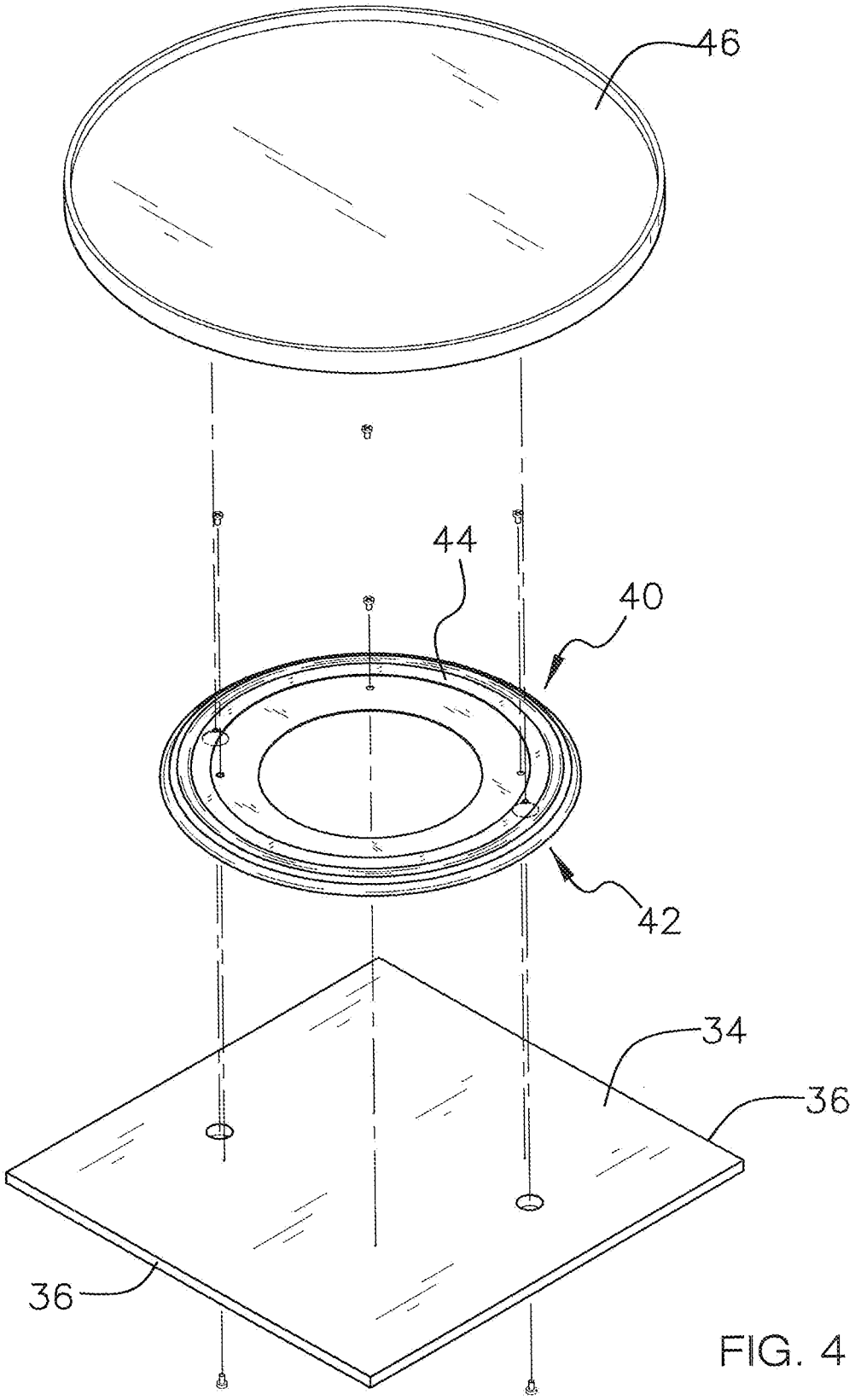
FIG. 4 is an exploded top front side perspective view of an embodiment of the disclosure.
Figure 5:
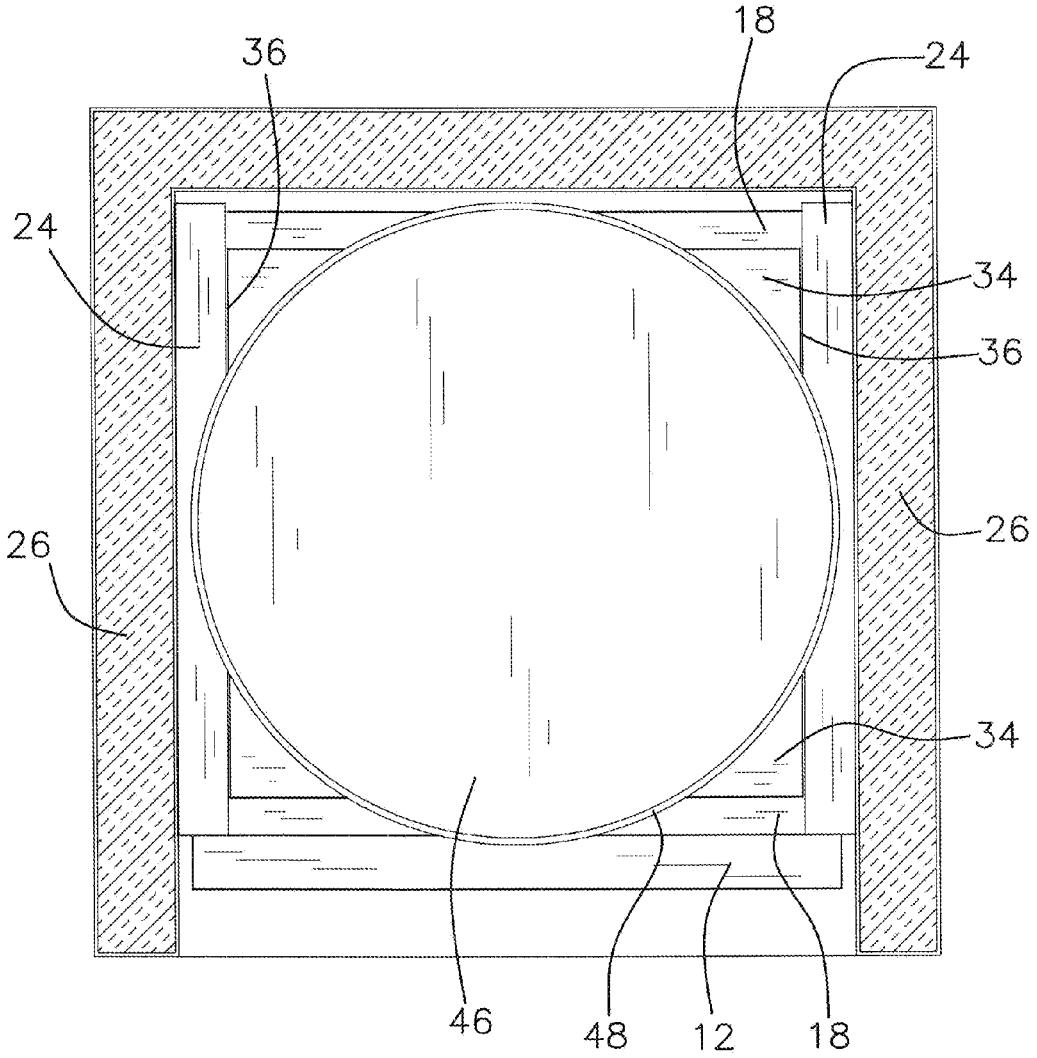
FIG. 5 is a top view of an embodiment of the disclosure positioned in a refrigerator.
Figure 6:
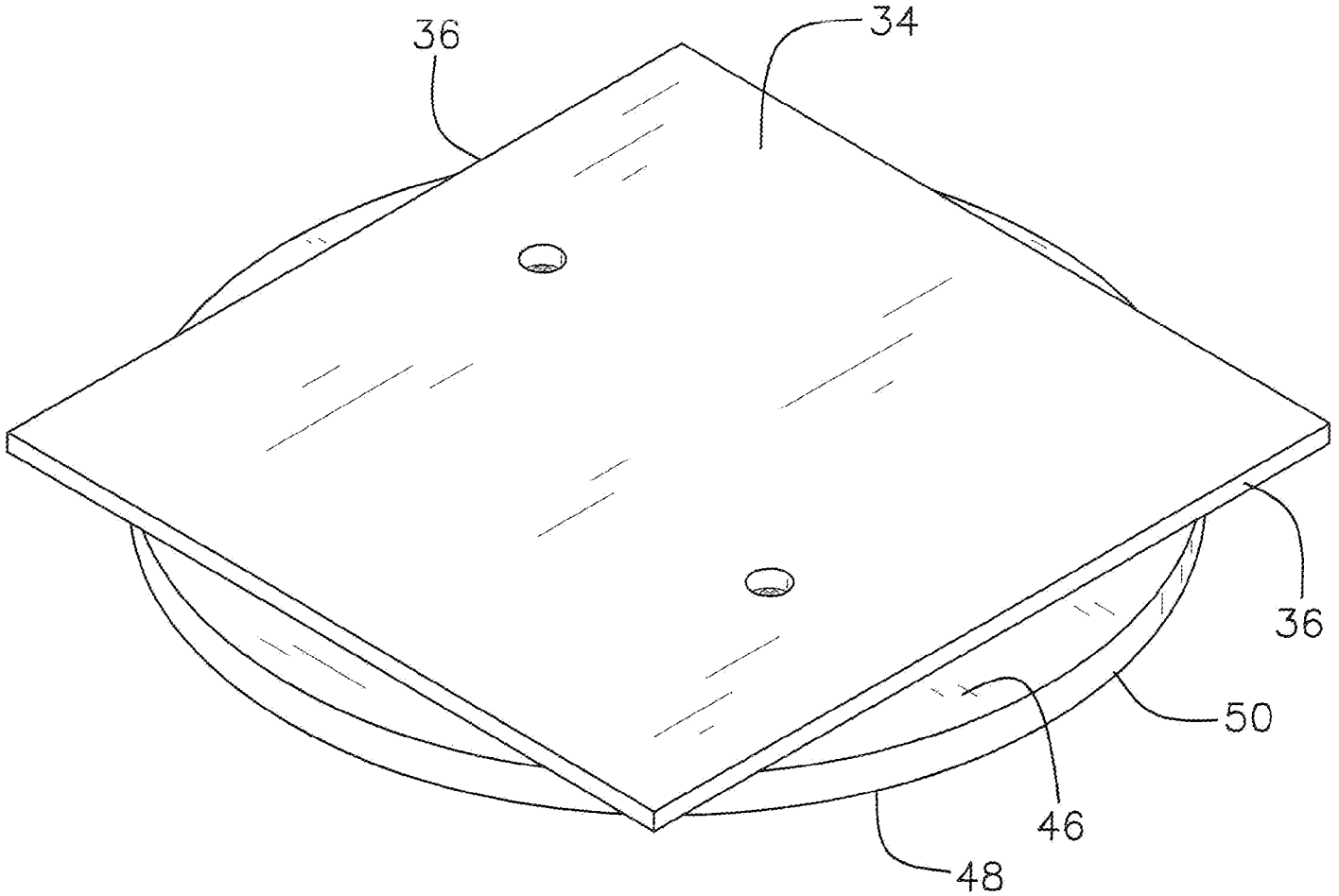
FIG. 6 is a bottom front side perspective view of an embodiment of the disclosure.

With reference now to the drawings, and in particular to FIGS. 1 through 6 thereof, a new refrigerator shelf device embodying the principles and concepts of an embodiment of the disclosure and generally designated by the reference numeral 10 will be described.

As best illustrated in FIGS. 1 through 6, the refrigerator turntable assembly 10 generally comprises a shelf 12 having opposed side edges 14. The shelf 12 may have a planar central section 16 and a frame 18 extending around the central section 16 of the shelf 12. An upper surface 20 of the central section 16 is horizontally offset from an upper surface 22 of the frame 18 wherein the upper surface 20 of the central section 16 of the shelf 12 is recessed relative to the frame 18. A pair of supports 24 is configured for coupling to opposed sides 26 of a refrigerator 28. The side edges 14 of the shelf 12 are supported by the supports 24 such that the shelf 12 is configured for holding items within the refrigerator 28. Each support 24 may have a pair of vertically spaced flanges 30,32. The shelf 12 may be slidably inserted between the spaced flanges 30,32 to further facilitate access to items on the shelf 12 by pulling the shelf 12 outwardly from the refrigerator 28.

A base 34 is positioned on the shelf 12. The base 34 may be rectangular having a pair of opposite side edges 36. Each of the side edges 36 of the base 34 is positioned adjacent to an associated one of the supports 24 in sufficient proximity that the base 34 effectively inhibited from twisting within the refrigerator 28 by the opposed sides 26 of the refrigerator 28. Each of the side edges 36 of the base 34 may be further positioned adjacent to an upper one of the spaced flanges 30 of an associated one of the supports 24. Thus, the base 34 is further inhibited from twisting within the refrigerator 28 by the upper one of the spaced flanges 30 of the associated one of the supports 24. The base 34 may further be positioned on the upper surface 20 of the central section 16 of the shelf 12 within the recess formed with the frame 18 wherein each of the side edges 36 of the base 34 is positioned adjacent to and abutting the frame 18. Thus, the base 34 is again inhibited from twisting within the refrigerator 28 by the frame 18.

A bearing plate 40 has a bottom surface 42 coupled to the base 34. A top surface 44 of the bearing plate 40 is rotatable relative to the bottom surface 42 of the bearing plate 40. A table 46 is positioned on and coupled to the top surface 44 of the bearing plate 40 wherein the table 46 is rotatable relative to the shelf 12. A lip 48 may be coupled to and extend upwardly from a perimeter edge 50 of the table 46 to inhibit items from sliding over the perimeter edge 50 of the table 46. The lip 48 may further be solid extending around the perimeter edge 50 of the table 46 to contain liquid spills or the like to the table 46 preventing soiling of the base 34 and the shelf 12. The perimeter edge 50 of the table 46 may be circular extending around the table 46 and may extend outwardly over the supports 24 to maximize storage space on the table 46.

In use, the shelf 12 is installed in the refrigerator 28. The base 34 is positioned on the shelf 12 as described above to provide stable support for the table 46. Items may then be selectively positioned on the table 46 to be kept in the refrigerator 28. When needed, the table 46 may be rotated to access items on the table 46 with or without sliding the shelf on the supports 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A refrigerator turntable assembly comprising:

a shelf having opposed side edges;

a pair of supports configured for coupling to opposed sides of a refrigerator, said side edges of said shelf being supported by said supports wherein said shelf is configured for holding items within the refrigerator;

a base positioned on said shelf, said base being rectangular and having a pair of opposite side edges, each of said side edges of said base being positioned adjacent to an associated one of said supports wherein said base is configured to be inhibited from twisting within the refrigerator by the opposed sides of the refrigerator;

a bearing plate having a bottom surface coupled to said base, a top surface of said bearing plate being rotatable relative to said bottom surface of said bearing plate; and a table coupled to said upper surface of said bearing plate wherein said table is rotatable relative to said shelf.

2. The assembly of claim 1, further comprising a lip coupled to and extending upwardly from a perimeter edge of said table.

3. The assembly of claim 2, further comprising said perimeter edge being circular extending around said table.

4. The assembly of claim 1, further comprising each said support having a pair of vertically spaced flanges, said shelf being slidably inserted between said spaced flanges.

5. A refrigerator turntable assembly comprising:

a shelf having opposed side edges;

a pair of supports configured for coupling to opposed sides of a refrigerator, said side edges of said shelf being supported by said supports wherein said shelf is configured for holding items within the refrigerator, each said support having a pair of vertically spaced flanges, said shelf being slidably inserted between said spaced flanges;

a base positioned on said shelf, said base being rectangular and having a pair of opposite side edges, each of said side edges of said base being positioned adjacent to an upper one of said spaced flanges of an associated one of said supports wherein said base is configured to be inhibited from twisting within the refrigerator by said upper one of said spaced flanges of said associated one of said supports;

a bearing plate having a bottom surface coupled to said base, a top surface of said bearing plate being rotatable relative to said bottom surface of said bearing plate; and a table coupled to said upper surface of said bearing plate wherein said table is rotatable relative to said shelf.

6. The assembly of claim 1, further comprising said shelf having a planar central section and a frame extending around said central section of said shelf, an upper surface of said central section being horizontally offset from an upper surface of said frame wherein said upper surface of said central section of said shelf is recessed.

7. A refrigerator turntable assembly comprising:

a shelf having opposed side edges, said shelf having a planar central section and a frame extending around said central section of said shelf, an upper surface of said central section being horizontally offset from an upper surface of said frame wherein said upper surface of said central section of said shelf is recessed;

a pair of supports configured for coupling to opposed sides of a refrigerator, said side edges of said shelf being supported by said supports wherein said shelf is configured for holding items within the refrigerator;

a base positioned on said shelf, said base being rectangular and having a pair of opposite side edges, said base being positioned on said upper surface of said central section of said shelf wherein each of said side edges of said base is positioned adjacent to and abutting said frame wherein said base is inhibited from twisting within the refrigerator by said frame;

a bearing plate having a bottom surface coupled to said base, a top surface of said bearing plate being rotatable relative to said bottom surface of said bearing plate; and a table coupled to said upper surface of said bearing plate wherein said table is rotatable relative to said shelf.

8. The assembly of claim 1, further comprising:

said shelf having a planar central section and a frame extending around said central section of said shelf, an upper surface of said central section being horizontally offset from an upper surface of said frame wherein said upper surface of said central section of said shelf is recessed;

each said support having a pair of vertically spaced flanges, said shelf being slidably inserted between said spaced flanges;

each of said side edges of said base being positioned adjacent to an upper one of said spaced flanges of an associated one of said supports wherein said base is configured to be inhibited from twisting within the refrigerator by said upper one of said spaced flanges of said associated one of said supports, said base being positioned on said upper surface of said central section of said shelf wherein each of said side edges of said base is positioned adjacent to and abutting said frame wherein said base is inhibited from twisting within the refrigerator by said frame; and a lip coupled to and extending upwardly from a perimeter edge of said table, said perimeter edge being circular extending around said table.

* * * * *